United States Patent [19]

Shelton

[11] 4,306,393

[45] Dec. 22, 1981

[54] SWIMMING POOL DECK SYSTEM

[76] Inventor: Don F. Shelton, P.O. Box 340424, Dallas, Tex. 75234

[21] Appl. No.: 801,618

[22] Filed: May 31, 1977

[51] Int. Cl.[3] ..... E02D 27/00

[52] U.S. Cl. ..... 52/169.7; 52/73; 52/251; 52/742

[58] Field of Search ..... 52/169.7, 169.8, 169.9, 52/251, 259, 73, 742; 4/172, 172.19; 61/49, 39

[56] References Cited

U.S. PATENT DOCUMENTS

| | | | |
|---|---|---|---|
| 3,086,220 | 4/1963 | Zars | 61/35 X |
| 3,511,002 | 5/1970 | Fox | 52/169.8 X |
| 3,612,470 | 10/1971 | Car et al. | 52/73 X |
| 4,008,547 | 2/1977 | Katzman | 4/172.19 X |

*Primary Examiner*—Carl D. Friedman

*Attorney, Agent, or Firm*—Hubbard, Thurman, Turner, Tucker & Glaser

[57] ABSTRACT

Outwardly extending support members are integrally joined to a reinforced concrete hull of a swimming pool. Peripheral deck slabs rest on the support members preventing deck pivoting due to earth settlement. The support members engage the sidewalls of the pool at a depth sufficiently below the water level such that water pressure provides a significant counteracting force to the sidewall in the area of greatest stress. Joints between adjacent deck slabs are formed above the support members so that each deck slab is at least supported at its opposite ends.

4 Claims, 7 Drawing Figures

SWIMMING POOL DECK SYSTEM

BACKGROUND OF THE INVENTION

The present invention pertains to swimming deck systems and methods for their construction.

Prior art deck systems include both freestanding and cantilever arrangements. Freestanding decks are supported entirely by the ground around the peripheral rim of the pool, and are therefore highly susceptible to tilting or dropping due to earth settlement under the deck. This is especially true where the pool site is graded, thus requiring the lower sides to be built up with fill which later settles to an even greater extent. In addition, a freestanding deck generally requires the added complexity of a waterproof expansion joint between its edge and the adjacent pool rim.

Cantilever decks have been designed with the intention of eliminating the above problems of freestanding decks. However, the effort heretofore has been only partially successful. Cantilever decks have a tendency to pivot at the pool rim, thereby frequently cracking the waterline tile that typically borders the upper inside edge of the pool walls. Due to ground settlement, the outer edge of the deck hasa tendency to drop under its own weight or under the influence of a superimposed load, thus causing the front edge of the deck to lift up. It is also possible for the back of the deck to lift up due to expansion of the ground as it absorbs water. In addition, it is not uncommon for the pool hull itself to fall or rise due to changes in the water content of the underlying ground.

U.S. Pat. No. 3,086,220, issued Apr. 23, 1963, is an example of an attempt in the prior art to solve the aforementioned problems of cantilevered decks by using an integrally formed deck and sidewall design. The problem of ground expansion was recognized and addressed by providing an air space under the deck to permit room for upward movement of the underlying earth. Integrally formed cantilever decks, however, are undesirable in that they place design constraints on the structure and are difficult to form. As will be appreciated, the present invention overcomes these and other prior art problems with a separately formed cantilevered deck and unique supporting system.

SUMMARY OF THE INVENTION

In accordance with the present invention a swimming pool deck and supporting structure comprises a pool hull having upstanding sidewalls with adjoining outwardly extending spaced members for supporting a peripheral deck. The deck projects out from an upper rim of the sidewall. The support members extend outward and engage the underside of the deck in a manner sufficient to prevent the deck from dropping. The support members engage the sidewall at a depth sufficient to prevent intolerable stresses in the sidewall.

The novel features believed characteristic of the invention are set forth in the appended claims. The nature of the invention, however, as well as its essential features and advantages may be understood more fully upon consideration of illustrative embodiments, when read in conjunction with the accompanying drawings, wherein:

DESCRIPTION OF THE PREFERRED EMBODIMENTS

Figure 1:
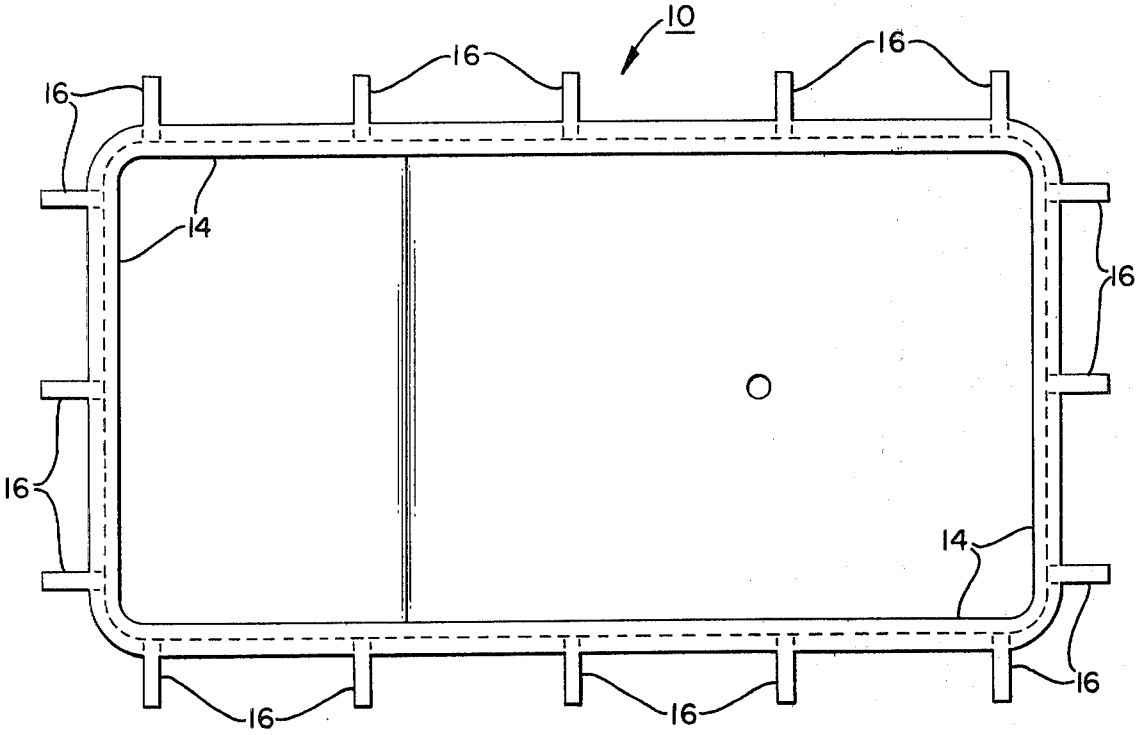
FIG. 1 is a plan view of a swimming pool hull in accordance with the present invention.
Figure 2:
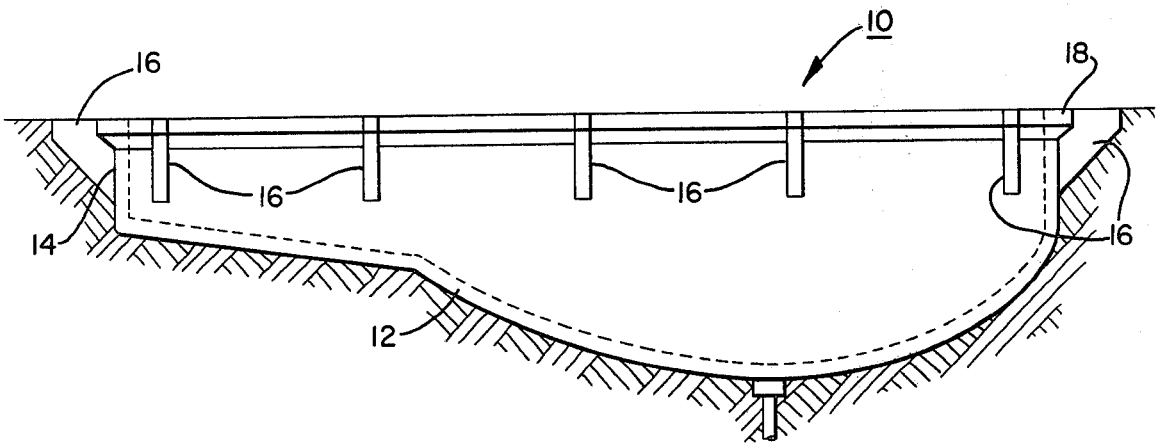
FIG. 2 is a view in elevation of the hull of FIG. 1.

In the description that follows, similar parts are designated by similar numerals in all figures in which they appear. FIGS. 1 and 2 depict a swimming pool hull made in accordance with the present invention and designated generally by reference numeral 10. The hull 10 comprises a monolithic structure of reinforced concrete having a bottom portion 12, sidewalls 14, and a number of generally regularly spaced footers 16 extending outwardly from the sidewalls 14. The upper rim of the sidewalls 14 terminates in a bond beam 18, which gives added strength to the hull structure 10.

In accordance with a preferred method, a basin is excavated in the earth and then manually shaped in the outline of the pool hull 10 in a manner known to contractors experienced in the construction of swimming pools. A shelf is formed in the shape of the outer edge of the bond beam 18 at the upper periphery of the basin. Grooves, preferably eight inches wide, are formed in the earth walls in the shape of the footers 16 at intervals of about six to seven feet. If the earth is not sufficiently cohesive to hold the desired shape, forms can be placed in the grooves and/or along the walls in an appropriate manner. A suitable material for the forms is a plasterboard such as Sheetrock which can be easily shaped and is sufficiently rigid for most purposes in retaining small amounts of loose soil. Reinforcing bars are arranged in a crisscross network with adjacent parallel bars about 12 inches apart along the sides and shallow end and about six inches apart along the bottom's deep end. Reinforcing bars for the foosters 16 and bond beam 18 are then arranged in a manner described more fully below.

With the re'bars in place, the pool hull 10 is preferably formed by pneumatically applying concrete against the earth walls of the basin to a thickness of about six inches, first in the bottom and then gradually up the sides and into the grooves, embedding the re'bars in concrete during the process. Before the concrete has dried, the inside surface of the hull 10 can be raked to remove irregularities. The presently most preferred method of concrete application is the pneumatic process called gunite, in which a mixture of sand and cement is driven by compressed air into a nozzle where it is mixed with water and then shot or sprayed out to form the pool hull 10. Gunite has long been known in the art of forming concrete structures as exemplified by U.S. Pat. No. 1,876,205, issued Sept. 6, 1932. Gunite is preferred over other forms of concrete not only for ease of application but also for its superior strength. The properties of gunite vary with its composition and manner of application. Structural integrity depend to a great extent on the skill of the nozzleman. The structural properties and manner of applying gunite are discussed in detail in *Shotcreting*, American Concrete Institute, 1966, Library of Congress Catalog Card No. 66-23958.

Figure 3:
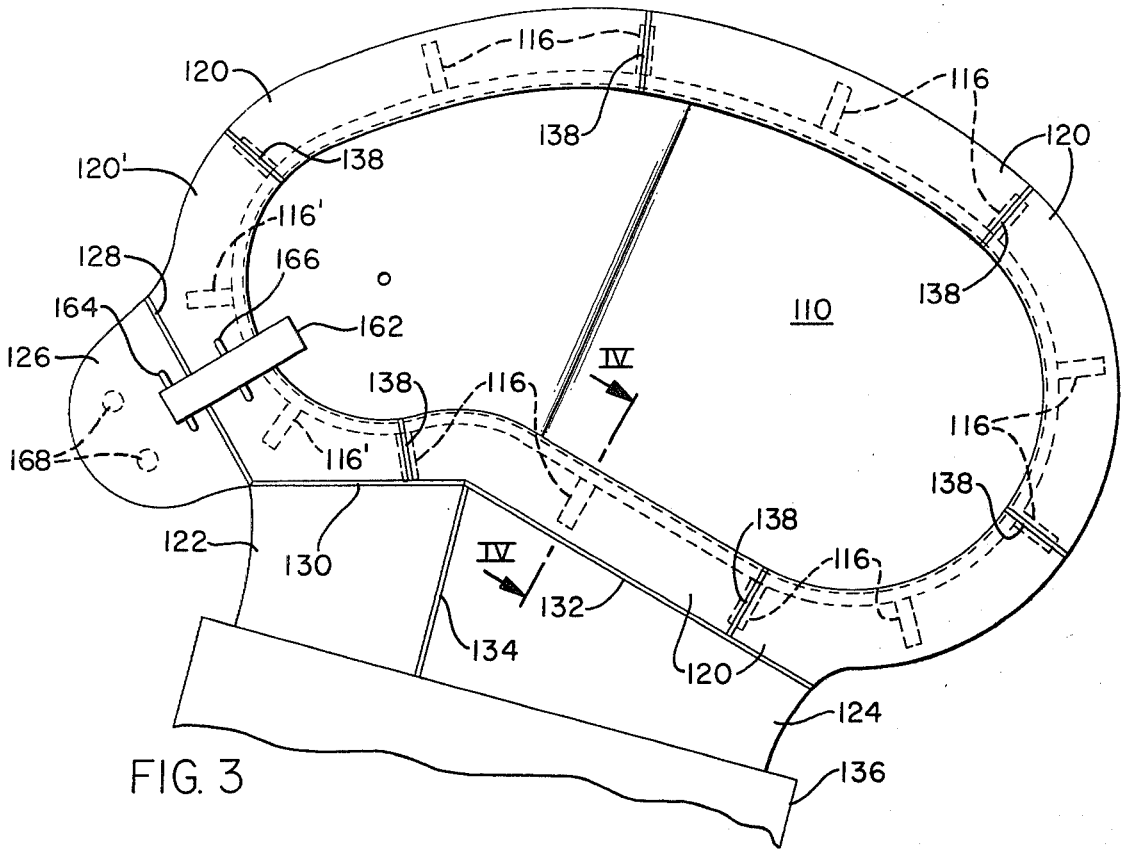
FIG. 3 is a plan view of a completed swimming pool illustrating additional features of the present invention.

The gunite process facilitates the formation of irregular pool geometries such as the kidney-shaped pool illustrated in FIG. 3. The figure shows a completed pool structure having a pool hull 110, peripheral deck slabs 120, patio sections 122 and 124 and a diving board pad 126, of which all except the gunited hull are formed of poured concrete using forms at the edges in accordance with known techniques. Ordinarily, the surfaces of the poured concrete are covered with a thin coating of an appropriate material such as Kooldeck. To permit relative movement of the various concrete sections, joints are formed in straight lines at convenient points, preferably using redwood 1×2's. Joints 128, 130 and 132 maintain an approximate deck width of four feet. Joint 134 runs along a convenient break between patio sections 122 and 124 in a direction generally perpendicular to a house or other structure 136. Separating the various deck slabs 120 are joints 138, each of which is preferably situated over the middle of a footer 116 so that each deck slab 120 is supported in part at its opposite ends by one-half the width of a footer 116.

Figure 4:
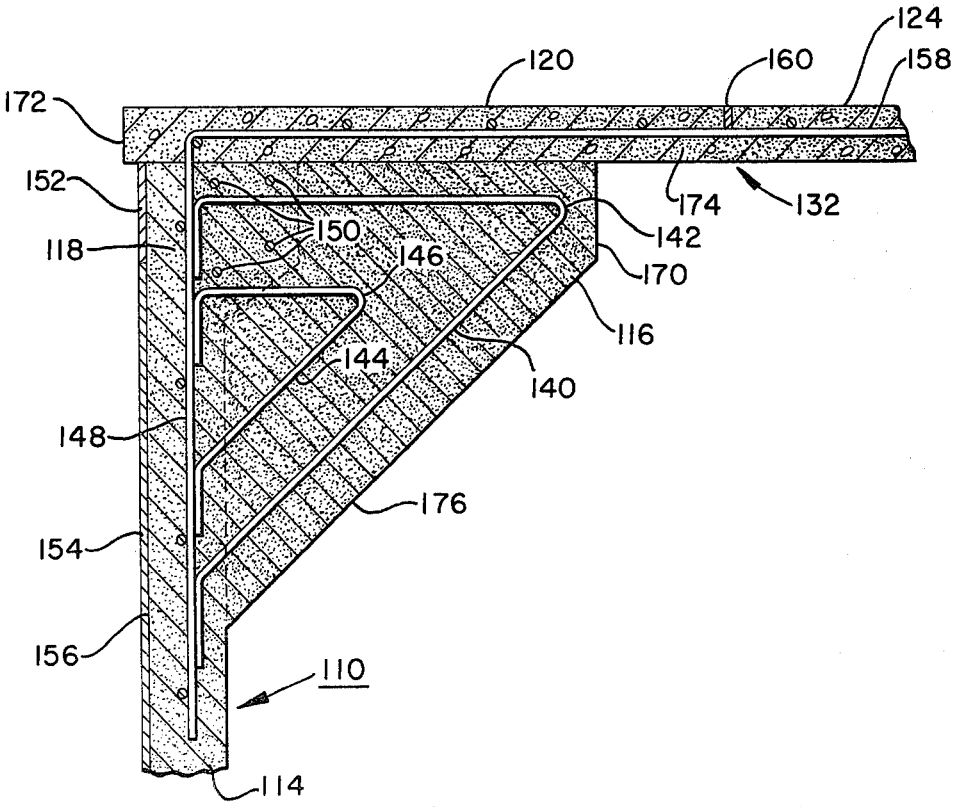
FIG. 4 is a vertical cross section taken along IV—IV of FIG. 3.

A sectional view taken through a typical deck slab 120 and its supporting footer 116 is illustrated in FIG. 4. The figure shows additional details of the monolithic pool hull 110 and the preferred manner in which the deck slab 120 is attached thereto.

A triangular arrangement of re'bars extends into the footer 116 from the network of re'bars in the sidewall 114. In particular, an outer re'bar 140 extends from a point of attachment in the bond beam 118 horizontally into an upper portion of the footer 116 to an elbow bend 142. Similarly, an inner re'bar 144 extends from a point of attachment in the sidewall 114 beneath the bond beam 118 horizontally into the footer 116 to an elbow bend 146. From the elbows 142 and 146 the re'bars 140 and 144 run diagonally downward and back into the sidewall 114 as shown. Prior to being embedded in concrete, the re'bars 140 and 144 can easily be fixed in place by wiring to a vertical re'bar 148 in the sidewall 114. Disposed in the bond beam 118 around the upper periphery of the pool hull 110 are four re'bars 150, which are supported by the sidewall network of re'bars in a manner illustrated more clearly in subsequent sectional views. The four re'bars 150 are typically ½ inch diameter steel, whereas the remaining re'bars in the hull 110 are typically ⅜ inch diameter steel. The sidewall 114 widens from its typical six-inch thickness to about twelve inches in the bond beam 118. A waterline tile 152 may be laid in place around the upper surface of the sidewall 114. Once the hull 110 has dried sufficiently, the deck slabs 120 and other surface sections are poured using forms at the edges, and then a plaster coating 154 is applied to the pool's surface 156 using known techniques.

In accordance with a preferred method of forming the deck slabs 120, a bed of fill is made between footers as will be described more fully below in conjunction with FIG. 5, and then a network of re'bars is laid where the deck is to be formed in similar fashion to the re'bars in the hull 110. Some of the various vertical re'bars 148 have free ends that extend out the top surface of the sidewalls 114 where they are bent over to form part of the deck network of re'bars. This causes the front end of the deck slabs 120 to be tied to the sidewalls 114 at the top of the bond beam 118. Re'bars run through the joints as typified by the re'bar 158 which extends through joint 132 tying the patio 124 to the adjacent deck slab 120. Shown in the joint 132 above the re'bar 158 is a redwood strip 160. Those skilled in the art will appreciate that relative movement of the patio 124 with respect to the deck 120 will cause the concrete to break where it is thinnest under the strip 160. The re'bars that run through joints are sufficiently flexible to permit such relative movement to a moderate degree without causing dislocation of the deck 120. In effect, the joints act as hinges between the deck slabs 120 and the various adjacent concrete sections 122, 124 and 126.

Referring briefly back to FIG. 3, a preferred mounting arrangement for a diving board 162 will now be described. A first standard 164 secures the rear of the board 162 to the concrete pad 126. The board 162 rests on a second standard 166 mounted in the deck 120' so that half, on typically somewhat more than half, of the board 162 projects beyond the second standard 166. Footers 116' are spaced closer than usual under the deck 120' about two feet on either side of the board 162 for added support. The hinge action of joint 128 permits settlement of the pad 126 without dislocation of the deck 120' or the pool hull 110. Relative movement of the pad 126 with respect to the deck 120' will of course cause raising or lowering of the front end of the diving board 162, which can be tolerated if kept to a minimum. Should it be necessary to form the pad 126 on loose earth or fill, an unacceptable degree of settling of the pad 126 can be prevented by sinking concrete piers 168 down to solid ground to provide the needed support for the pad 126.

Although the placement and shape of the footers 116 and the arrangement of the deck slabs 120 and joints 138 can be varied from that shown in FIGS. 3 and 4, the following preferred dimensions have been found experimentally to be quite satisfactory. Given a four-foot wide deck 120 of four inches in thickness, a spacing of six to seven feet between footers 116 is preferred. The typical footer 116 shown in FIG. 4 is preferably about eight inches thick and extends about two feet back from the bond beam 118 to its back edge 170. Since the sidewall 114 is about one foot thick in the bond beam 118, the footer 116 and sidewall 114 provide about three feet of support for the deck 120. A front extension of the deck 120 forms a splash lip 172, which overhangs the waterline tile 152 by about two inches. Accordingly, there exists a rear extension 174 of about ten inches of deck beyond back edge 170 of footer 116. The back edge 170 extends generally downwards for about eight inches where it meets a lower diagonal surface 176. The resulting shape gives added strength to the rear of the footer 116 where the stress of the superimposed load is the greatest. The diagonal surface 176 meets the sidewall 114 at a preferred depth of about three feet below the top of the bond beam 118.

Although the above dimensions for the deck and supporting structure are preferred, a relatively wide degree of variations can achieve satisfactory results. For example, the back edge 170 of the footer 116 might be positioned anywhere between about the center of the deck 120 and its outer edge just inside of the joint 132. It is believed, however, that the likelihood of deck pivoting due to possible heavy exterior loading at the rear thereof would be too great if more than half of the deck 120 were permitted to cantilever beyond the footer's edge 170. On the other hand, extension of the footer 116 out to the full width of the deck 120 would unnecessarily add weight and cost to the structure.

The slope of the footer's lower surface 176 might also be varied with satisfactory results. Extending the footer 116 farther down the sidewall 114 would distribute the stress more effectively, but would also require more concrete and hence more weight. The preferred depth of three feet for footer 116 has been found to give satisfactory results when the sidewall 114 and footer 116 are integrally formed with a high quality qunite having about a 4500 psi rated compressive strength after 28 days. In any event, the footer 116 should extend far enough down the sidewall 114 to prevent excessive stress in the sidewall 114 or footer 116.

It will be appreciated that the dead load of the deck and any live load placed thereon produces a bending moment on the sidewall 114. The internal stresses are such as to produce compression in the lower area of the footer-sidewall interface and tension in the upper area thereof in the vicinity of the bond beam 118. An advantageous feature of the monolithic hull structure is that such stresses are distributed evenly in the sidewall 114 by the integrally formed footer 116. The upper horizontal portions of re'bars 140 and 144 help keep the footer 116 from cracking and pulling away from the bond beam 118. The outer re'bar 140, which extends into the heavily reinforced bond beam 118, is particularly useful in this respect.

The present deck system advantageously employs water pressure to provide a force against the sidewall 114 to counteract the stresses produced by the lower portion of the footer 116. The sidewall 114 is of course designed to be sufficiently strong to withstand the expected forces when the pool is empty; however, the additional effect of the water pressure reduces fatigue in the sidewall 114, thereby extending its useful life. Due to lateral spreading of stresses in the sidewall 114, the effective surface area for counteracting the stresses is substantially larger than the cross-sectional area of the footer 116 through which the compressive forces are applied. Therefore, the counteracting force of the water can be significant. For example, given the preferred dimensions of the embodiment shown in FIGS. 3 and 4, it is estimated that roughly one third of the dead load of the deck and footers is counteracted by water pressure when the pool is full.

Figure 5:
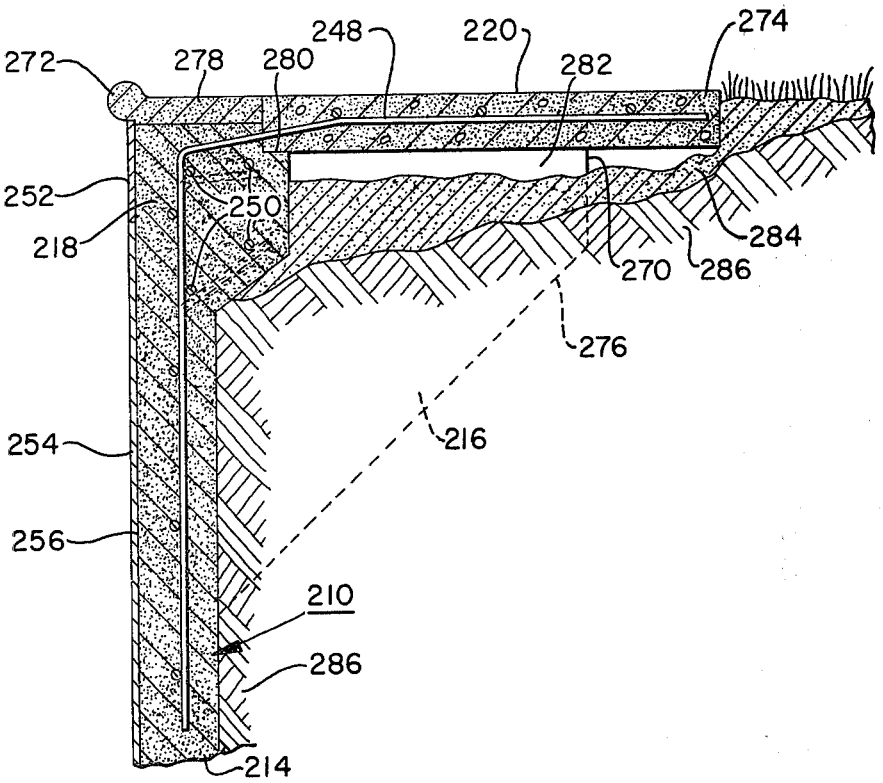
FIG. 5 is a sectional view similar to that of FIG. 4 illustrating an alternate embodiment of the present invention.

An alternate embodiment of a deck system and supporting structure is illustrated by FIG. 5, the principal difference being the addition of a coping stone 278 on top of the bond beam 218 mainly for aesthetic purposes. The coping stone 278 is about two inches thick and has a splash lip 272 protruding out over the waterline tile 252.

The addition of the coping stone 278 necessitates certain modifications. The re'bars 248 used for tying the deck 220 to the sidewall 214 must be bent over horizontally prior to forming the concrete bond beam 218. A shelf 280 for supporting the front end of the deck 220 is formed preferably by removing a 2×2 inch section from the outer periphery of the bond beam 218 before it has hardened. Since the center of gravity of the deck slab 220 is farther removed from the sidewall 214 and the tie between deck and sidewall is less desirable, it may be advisable to extend the rear edge 270 back a few inches farther than for the embodiment of FIG. 4.

Other structural features of the embodiment of FIG. 5 are essentially the same as the embodiment of FIG. 4. Although the embodiment of FIG. 4 is less costly than that of FIG. 5, both embodiments exhibit the feature of a separately formed deck slab supported by an integrally formed footer and sidewall.

The sectional view of FIG. 5 illustrates a typical cavity 282 which occurs in time due to ground settlement under the deck 220. As described in U.S. Pat. No. 3,086,220, the formation of the cavity 282 is not only anticipated but is an intended beneficial feature. It provides room for expansion of the earth after a heavy rain.

In accordance with the present invention, the cavity 282 is formed by providing a fill 284 of sand and loose dirt above solid earth 286 to form a bed on which the deck 220 is poured. Just prior to pouring the deck 220 the fill is saturated with water to prevent its compaction during the several hours needed for the concrete deck to set sufficiently to support itself. Later as the fill 284 dries, it begins to settle and fall away from the deck 220, thus forming the cavity 282.

Figure 6:
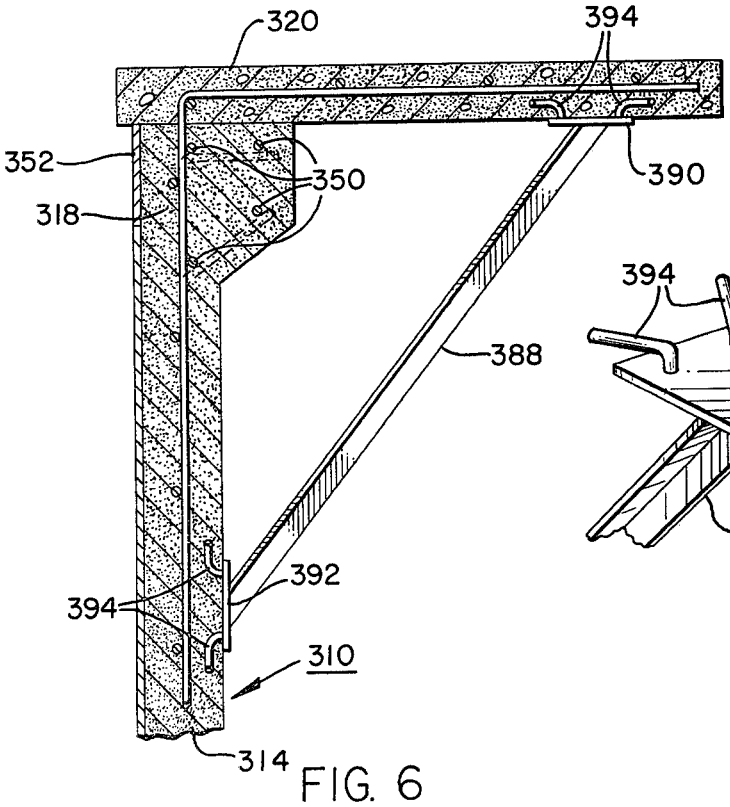
FIG. 6 is a sectional view similar to that of FIG. 4 illustrating yet another alternate embodiment thereof.
Figure 7:
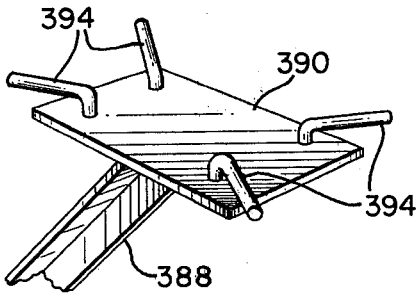
FIG. 7 is a view in perspective of a member of the embodiment of FIG. 6.

Referring to FIG. 6 there is shown an alternate deck support system wherein a metal brace 388 is substituted for the integrally formed concrete footers previously described. The brace 388 is preferably a galvanized steel angle iron about five feet in length. Attached to the ends of the brace 388 are ¼-inch thick steel plates 390 and 392, which abut the deck 320 and sidewall 314 in the manner shown. The plates have pins 394 extending into the concrete to anchor the opposite ends of the brace 388 in the deck 320 and sidewall 314. The pins 394 are preferably four in number as shown in FIG. 7, so that the brace 388 can conveniently support the ends of the adjacent deck slabs with two pins anchored in each slab. Other structural features are similar to those of the previously described embodiments.

The brace 388 of FIG. 6 is well suited to certain special applications, but is generally a less desirable support member than an integrally formed concrete footer. The brace arrangement might facilitate the formation of a deck at some height above the ground, as may at times be desirable. It should be appreciated, however, that higher stresses in the sidewall 314 are likely caused by such a brace arrangement. The horizontal component of the force exerted by the brace 388 against the sidewall 314 can be reduced by placing the plate 392 farther down the sidewall 314, thus compensating for the comparatively higher stress concentration. Placement of the plate 392 with its center about four feet down from the top of sidewall 314 as shown in FIG. 6 should be suitable for a well-constructed hull 310 using brace intervals of about six feet.

The above described preferred embodiments exhibiting the separately formed decks have advantages over the prior art structure of an integrally formed deck exemplified by U.S. Pat. No. 3,086,220. For example, no convenient technique is known for forming a splash lip while pneumatically applying concrete to integrally form a cantilevered deck with the sidewall in the manner of said patent. A separate coping stone or the like must be supplied for that purpose. On the other hand, there is no difficulty in forming the splash lip 172 as an integral portion of the deck 120 as exemplified in FIG. 4 by appropriate placement of forms prior to pouring the concrete deck 120, thus eliminating the need for a separate coping stone. In addition, a poured concrete deck can be troweled smooth, whereas gunited decks set so rapidly that they must later undergo costly resurfacing. Furthermore, should a separately formed deck be damaged, it would be much easier to repair than an integrally formed deck.

Accordingly, it will be appreciated that the present invention not only solves the problem of deck dropping or pivoting, but also provides the versatility of a separately formed deck of poured concrete. The use of support members at spaced intervals permits cantilevering of wider decks which are capable of carrying heavier loads than was heretofore possible. The preferred method of integrally forming the support members as exemplified by FIGS. 4 and 5 permits great variety in design without complicated or expensive construction techniques.

Although preferred embodiments of the invention have been described in detail, it is to be understood that various changes, substitutions and alterations can be made therein without departing from the spirit and scope of the invention as defined by the appended claims.

What is claimed is:

1. A swimming pool structure comprising:

a monolithic pool hull of pneumatically applied reinforced concrete formed against the walls of an excavated basin, the hull having upstanding sidewalls rimmed at their upper periphery by a bond beam, the sidewalls having integrally formed footers extending outward at spaced intervals, the footers being formed by pneumatic application of concrete into grooves in the walls of the basin contemporaneously with the formation of the sidewalls, at least one poured concrete deck slab, each deck slab being tied in front to the bond beam and supported at opposite ends by footers, and means disposed between footers for forming a cavity between the ground and the underside of the deck slabs, wherein each footer has an upper horizontal supporting surface essentially flush with the upper surface of the bond beam, a lower diagonal surface meeting the sidewall below the bond beam at a depth sufficient to prevent intolerable stresses in the sidewall, and a rear surface extending essentially vertically downward from the horizontal surface to the lower diagonal surface.

2. The structure of claim 1 wherein a generally triangular-shaped reinforcing bar extends from a point in the bond beam to an elbow bend near the rear surface of the footer, and from the elbow bend diagonally back to a point in the sidewall.

3. In combination, a swimming pool and diving board comprising:

a concrete pool hull formed in an excavated basin, a cantilevered concrete deck projecting outward from the pool hull, a concrete pad disposed on the ground adjacent to the deck, a joint separating the deck and the pad, reinforcing bars extending through the joint to tie the pad to the deck, a first standard anchored in the pad, a second standard anchored in the deck, a diving board secured at one end to the first standard and supported along its length by the second standard, and supports attached to the pool hull for supporting the underside of the deck on opposite sides of the diving board.

4. A method of forming a cavity under a swimming pool deck comprising the steps:

(a) forming support members for the deck, (b) providing a bed of loose fill between the support members, (c) saturating the fill with water, and (d) pouring concrete on the bed and adjacent support members while the fill is substantially saturated, whereby as the fill is allowed to dry it will settle and fall away from the concrete thereby forming the cavity.

* * * * *